US011737561B2

(12) United States Patent
Schuster

(10) Patent No.: US 11,737,561 B2
(45) Date of Patent: Aug. 29, 2023

(54) SEATING FURNITURE HAVING DUAL-MOTOR WALL-AWAY FUNCTION

(71) Applicant: M. SCHUSTER PATENTVERWERTUNGS GMBH, Leverkusen (DE)

(72) Inventor: Michael Schuster, Hannover (DE)

(73) Assignee: M. SCHUSTER PATENTVERWERTUNGS GMBH, Leverkusen (DE)

( * ) Notice: Subject to any disclaimer, the term of this patent is extended or adjusted under 35 U.S.C. 154(b) by 0 days.

(21) Appl. No.: 17/596,935

(22) PCT Filed: Jun. 28, 2020

(86) PCT No.: PCT/DE2020/100560
§ 371 (c)(1),
(2) Date: Dec. 22, 2021

(87) PCT Pub. No.: WO2021/000994
PCT Pub. Date: Jan. 7, 2021

(65) Prior Publication Data

US 2022/0312968 A1 Oct. 6, 2022

(30) Foreign Application Priority Data

Jun. 29, 2019 (DE) ..... 10 2019 117 625.5

(51) Int. Cl.
*A47C 1/022* (2006.01)
*A47C 1/034* (2006.01)
(Continued)

(52) U.S. Cl.
CPC ..... *A47C 1/022* (2013.01); *A47C 1/034* (2013.01); *A47C 1/035* (2013.01); *A47C 1/037* (2013.01); *A47C 1/0345* (2013.01); *A47C 7/5068* (2018.08)

(58) Field of Classification Search
CPC ..... A47C 1/035; A47C 1/022; A47C 1/034; A47C 1/0345; A47C 1/037; A47C 7/5068;
(Continued)

(56) References Cited

U.S. PATENT DOCUMENTS 3,400,975 A 9/1968 Rogers
3,865,432 A 2/1975 Rogers et al.
(Continued)

FOREIGN PATENT DOCUMENTS

CN 204292604 U 4/2015
DE 2425731 A1 1/1975
(Continued)

OTHER PUBLICATIONS

Citation of Office Action dated Jan. 13, 2018 in related/corresponding DE Application No. 10 2018 100 008.1.
(Continued)

*Primary Examiner* — Robert Canfield
(74) *Attorney, Agent, or Firm* — PATENT PORTFOLIO BUILDERS PLLC

(57) ABSTRACT

Seating furniture includes at least a first and a second linear actuator to adjust the seat part, the foot part, and the back part between the seating and the reclining position. The first linear actuator generates a linear stroke causing the back part to be adjusted relative to the seat part. The second linear actuator generates a linear stroke having at least a first and second partial stroke, The first partial stroke causes, during adjustment of the seating furniture from the seating position into the reclining position, the seat part to slide relative to the frame towards the front, and simultaneously the inclination of the seat part to be adjusted, there being no extension or retraction of the foot part relative to the seat part during this first partial stroke of the second linear actuator. The second
(Continued)

linear actuator causes the foot part to extend relative to the seat part by a second partial stroke following the first partial stroke.

16 Claims, 10 Drawing Sheets

(51) Int. Cl.
*A47C 7/50* (2006.01)
*A47C 1/035* (2006.01)
*A47C 1/037* (2006.01)

(58) Field of Classification Search
CPC ..... A47C 1/0355; A47C 7/506; A47C 7/002; A47C 7/02; A47C 7/462; A47C 7/58
See application file for complete search history.

(56) References Cited

U.S. PATENT DOCUMENTS

| | | | | |
|---|---|---|---|---|
| 5,588,710 | A | 12/1996 | Wiecek | |
| 6,840,575 | B2 * | 1/2005 | Hesse | A47C 1/0355 297/75 |
| 6,974,186 | B1 * | 12/2005 | Chang | A47C 1/035 297/69 |
| 9,743,770 | B1 * | 8/2017 | Pollard | A47C 1/0355 |
| 2012/0248831 | A1 | 10/2012 | Garland | |
| 2013/0062914 | A1 * | 3/2013 | Marshall | A47C 7/506 297/69 |
| 2015/0054315 | A1 | 2/2015 | Donovan et al. | |
| 2015/0272329 | A1 | 10/2015 | Lawson | |
| 2017/0071344 | A1 * | 3/2017 | Marcantoni | A47C 1/029 |
| 2019/0216221 | A1 * | 7/2019 | Bryant | A47C 1/023 |
| 2022/0071396 | A1 * | 3/2022 | Zhang | A61G 5/128 |
| 2022/0312967 | A1 * | 10/2022 | Schuster | A47C 1/0355 |

FOREIGN PATENT DOCUMENTS

| | | | |
|---|---|---|---|
| DE | 29708057 | U1 | 7/1997 |
| DE | 69609540 | T2 | 4/2001 |
| DE | 202016104973 | U1 | 10/2016 |
| DE | 202016008342 | U1 | 8/2017 |
| DE | 102018100008 | A1 | 7/2019 |
| DE | 102018108896 | A1 | 7/2019 |
| DE | 102018108897 | A1 | 7/2019 |
| DE | 102018108898 | A1 | 7/2019 |
| EP | 3143902 | A1 | 3/2017 |
| WO | 2019134889 | A1 | 7/2019 |

OTHER PUBLICATIONS

Citation of Office Action dated Jan. 4, 2019 in related/corresponding DE Application No. 10 2018 108 896.5.
Citation of Office Action dated Jan. 4, 2019 in related/corresponding DE Application No. 10 2018 108 897.3.
Citation of Office Action dated Jan. 4, 2019 in related/corresponding DE Application No. 10 2018 108 898.1.
International Search Report dated Feb. 13, 2019 in related/corresponding International Application No. PCT/EP2018/097048.
International Search Report dated Sep. 30, 2020 in related/corresponding International Application No. PCT/DE2020/100560.
Written Opinion dated Sep. 30, 2020 in related/corresponding International Application No. PCT/DE2020/100560.

* cited by examiner

SEATING FURNITURE HAVING DUAL-MOTOR WALL-AWAY FUNCTION

BACKGROUND AND SUMMARY OF THE INVENTION

Exemplary embodiments of the invention relate to a piece of seating furniture having a chassis, a seat part that can be pivoted in terms of inclination, a back part that can be pivoted relative to the seat part, and a foot part that can be pivoted out and is connected to the seat part via at least one foot-part adjusting mechanism, wherein, in order to adjust the seating furniture from an upright sitting position into a reclining position, the seat part is displaced forwards relative to the chassis, wherein the foot part is pivoted in substantially below the seat part in the sitting position and is pivoted out in front of the seat part in the reclining position in such a way that the seat part is extended by the foot part.

In particular, exemplary embodiments of the present invention relate to such seating furniture in which the backrest can be pivoted in a wall-away manner and which is therefore colloquially also referred to as sofas with wall-away function. This means that, when pivoted into a reclining position, the backrest moves forward together with the seat part relative to the chassis, so that the backrest does not, or only insignificantly, protrude beyond the rear edge of the seating furniture in any pivoted position.

In the case of seating furniture of the type described in EP3143902A1, a sequence of adjustment functions for the seat part, back part, and foot part with two intermediate positions between the sitting and reclining positions is known.

In this case, in a first adjustment step, the seat part is moved forwards and, in the process, the rear region of the seat part is lowered and the front region of the seat part is raised, so that the seat part is adjusted in inclination with respect to the sitting position, wherein the foot part is not yet extended in this first intermediate position of the seating furniture, which is also referred to as the "lounge position".

In a second adjustment step, the foot part is extended in front of the seat part without further adjustment of the seat part, whereby a second intermediate position, also referred to as the "relax position", is reached.

In a third adjustment step, the seat part is then moved further forwards and the back part is pivoted synchronously with the movement into a reclining position.

According to EP3143902A1, in order to achieve the above-mentioned motion sequences, two linear actuators are required, wherein a foot-part linear actuator between the seat part and the foot-part adjusting mechanism and a back-part linear actuator acts between the seat part and the chassis, wherein, during the adjustment of the seating furniture from the sitting to the reclining position, the back-part linear actuator is first actuated in an electronically controlled sequence in order to adjust the inclination of the seat part and thus to create a greater distance between the front edge of the seat part and the ground, in order to be able to extend the longest possible footrest.

After this adjustment step, the foot-part linear actuator is then actuated to extend the foot part. Only after the foot part has been fully extended is the back-part linear actuator operated again with the aid of the electronic control to adjust the backrest in respect of its inclination.

The disadvantage here is that, despite the use of two linear actuators, it is not possible for the user to adjust the back part and the foot part independently of each other due to the electronically controlled adjustment process.

If the aforementioned electronic control were to be dispensed with, the length of the foot part would then be restricted, since if the foot part were to be adjusted, it would then also have to pass the floor in a seat part position that was not adjusted in terms of inclination.

Based on the described prior art, exemplary embodiments of the invention are directed to further designing a seat of the generic type in such a way that, when using two linear actuators for adjusting the seat part, the back part and the foot part with two intermediate positions located between the sitting and the reclining position according to the publication EP3143902A1, the back part and the foot part can be adjusted independently of each other without having to restrict the length of the foot part.

By means of the features according to the invention, it is possible to provide a seating furniture of the type according to the invention, which ensures an adjustment of the back part and the foot part, which can be actuated independently of each other, and additionally an adjustment of the back part and the seat part, which can be actuated independently of each other.

Thereby, in each adjustment position of the foot part or the seat part, a wall-away adjustment of the back part into any desired pivoting position is possible, and in each adjustment position of the back part, the foot part or the seat part can be pivoted into any desired position.

The foot part is not limited in length and can have the same length as the seating furniture known from EP3143902A1.

Thereby, according to the present invention, in contrast to the seating furniture known from EP3143902A1, the foot-part linear actuator acts between the foot-part adjusting mechanism and a transverse strut guided displaceably both relative to the chassis and relative to the seat part, and the back-part linear actuator acts between the chassis and the transverse strut guided displaceably both relative to the chassis and relative to the seat part.

When the foot-part linear actuator is actuated, a first linear partial stroke is generated and the seat part is moved forwards and adjusted in its inclination at the same time.

When the foot-part linear actuator is operated further, a second linear partial stroke is generated and the foot part is extended as a result.

Due to the adjustment sequence according to the invention, which takes place when the foot-part linear actuator is actuated, in which the seat part is first adjusted in inclination and only then is the foot part extended, an electronic control system, as known from EP3143902A1, can be dispensed with without limiting the length of the foot part.

Furthermore, because the back part and the foot part/seat part can be adjusted independently of one another, a large number of additional adjustment combinations of the foot part, the seat part, and the back part are made possible in comparison with the seating furniture known from EP3143902A1, as a result of which the adjustment comfort of a seating furniture according to the invention is increased.

BRIEF DESCRIPTION OF THE DRAWING FIGURES

An exemplary embodiment of the invention is described below with reference to the accompanying drawing, wherein.

Figure 3:
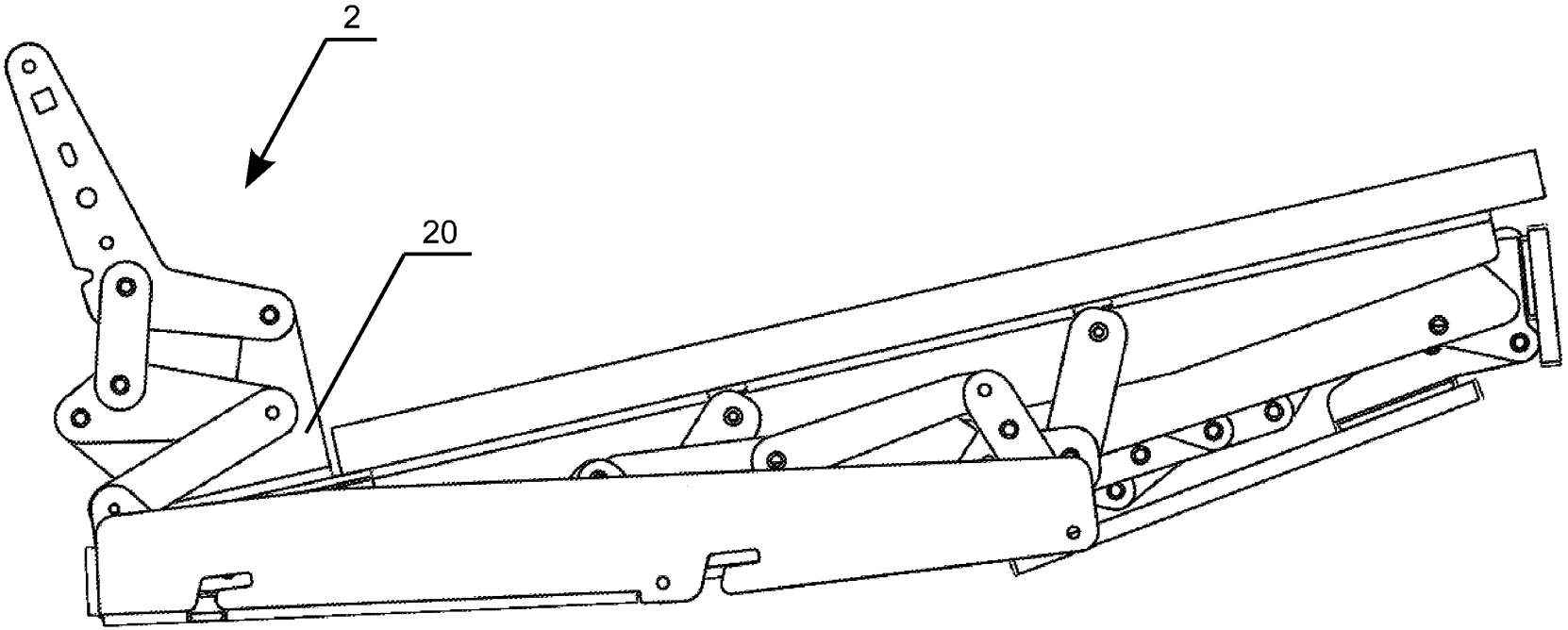
FIG. 3 shows a piece of seating furniture according to the invention in a first intermediate position.
Figure 5:
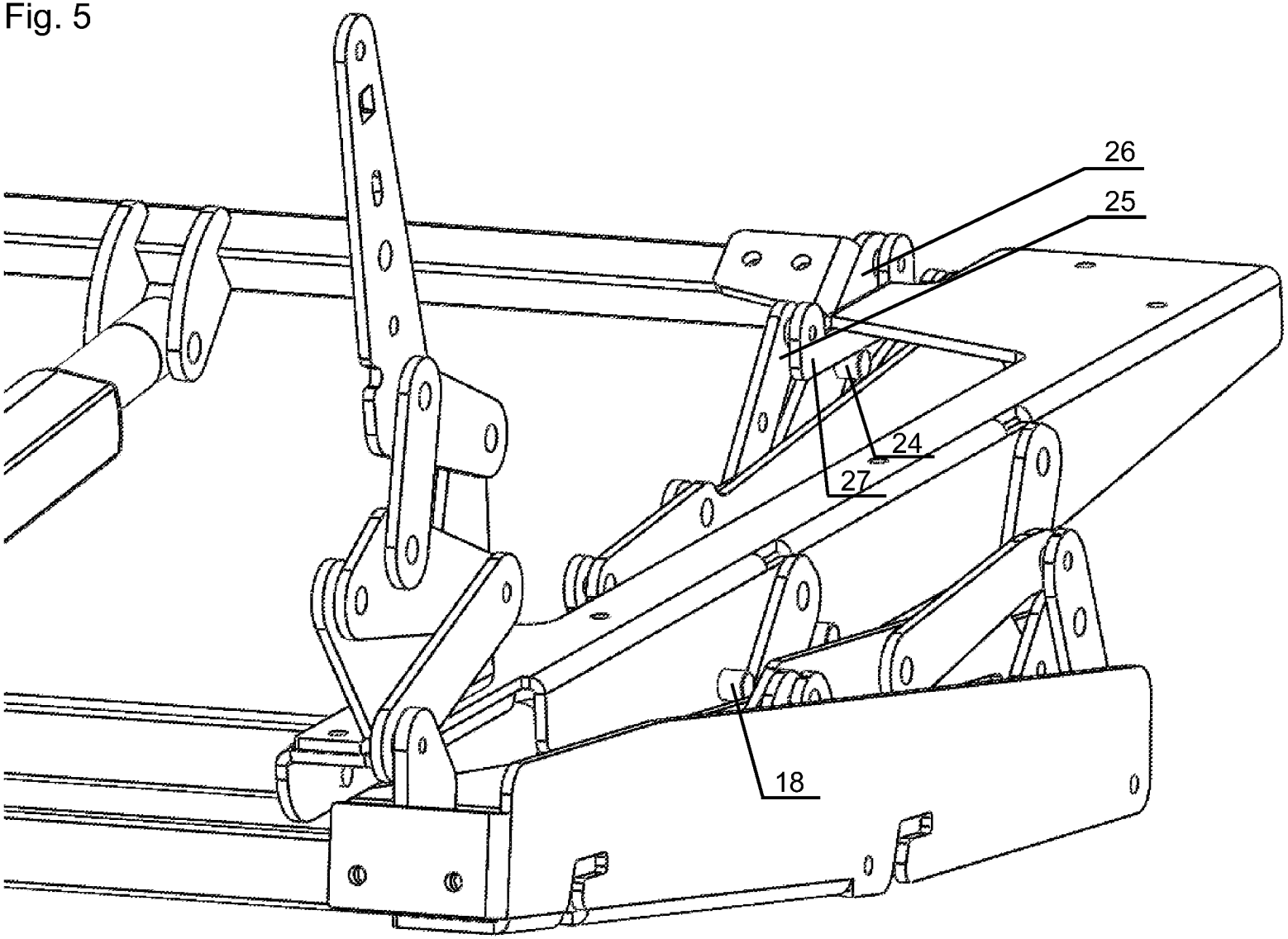
Figure 6:
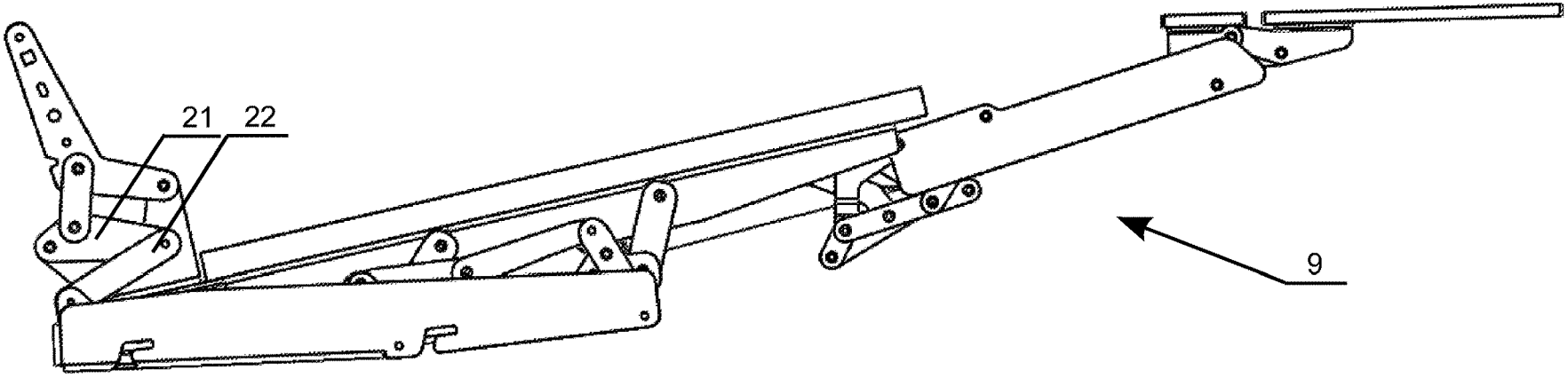
Figure 7:
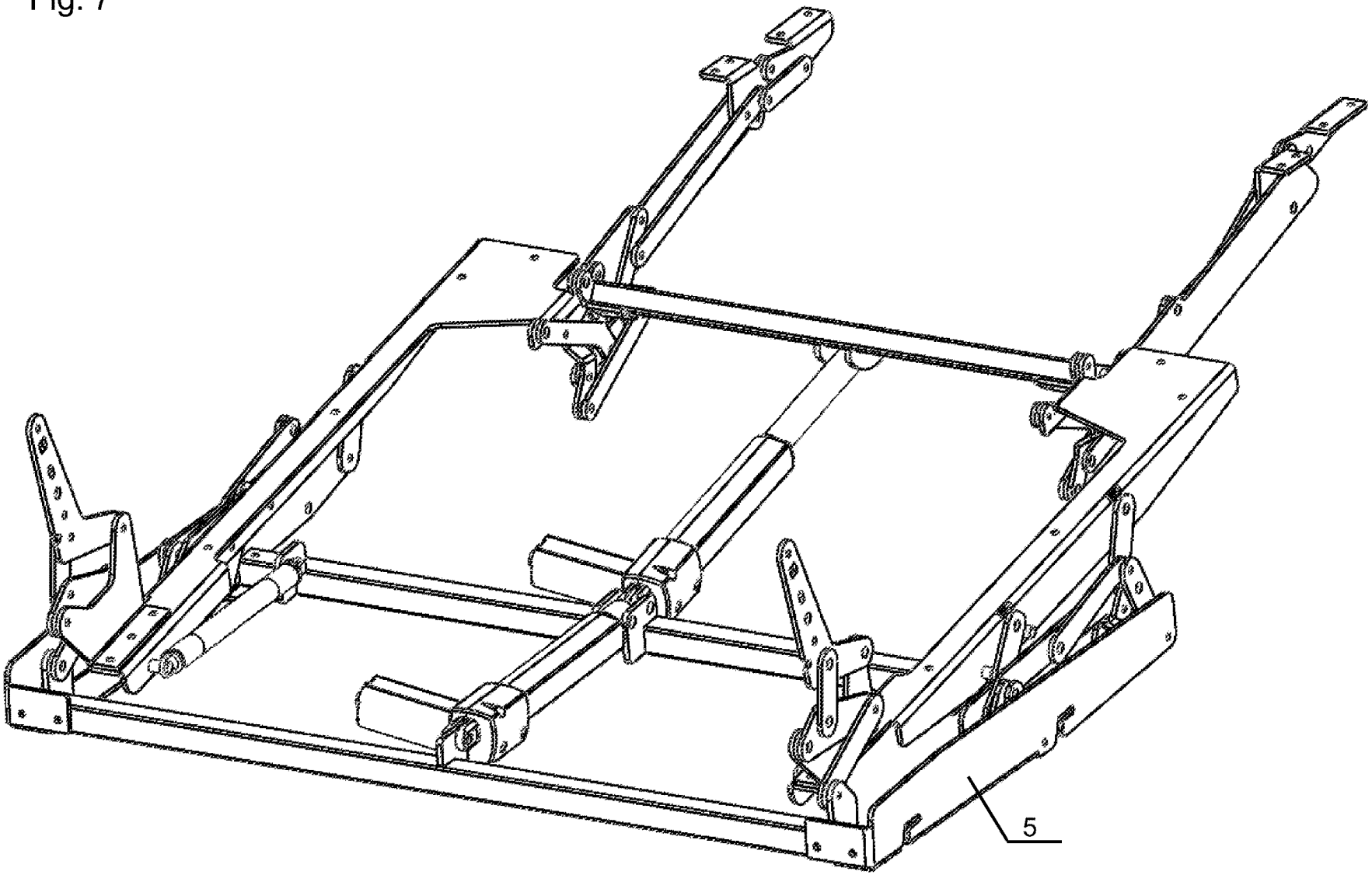
Figure 8:
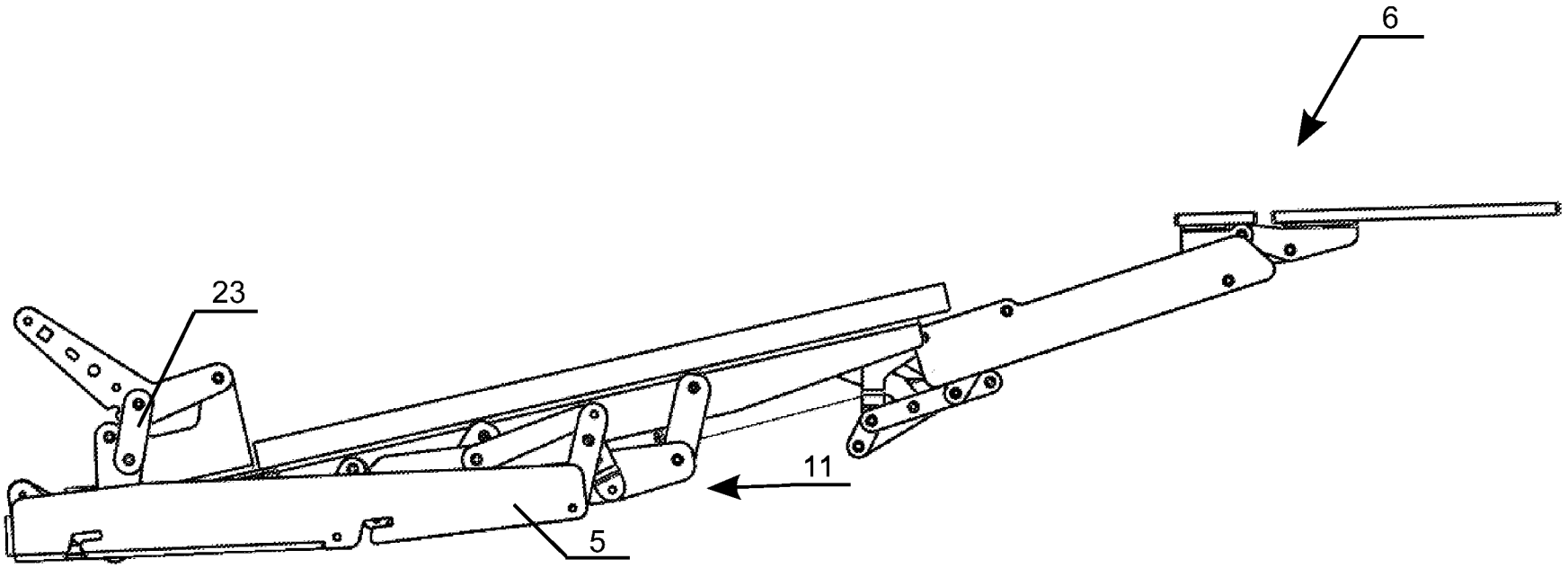
Figure 9:
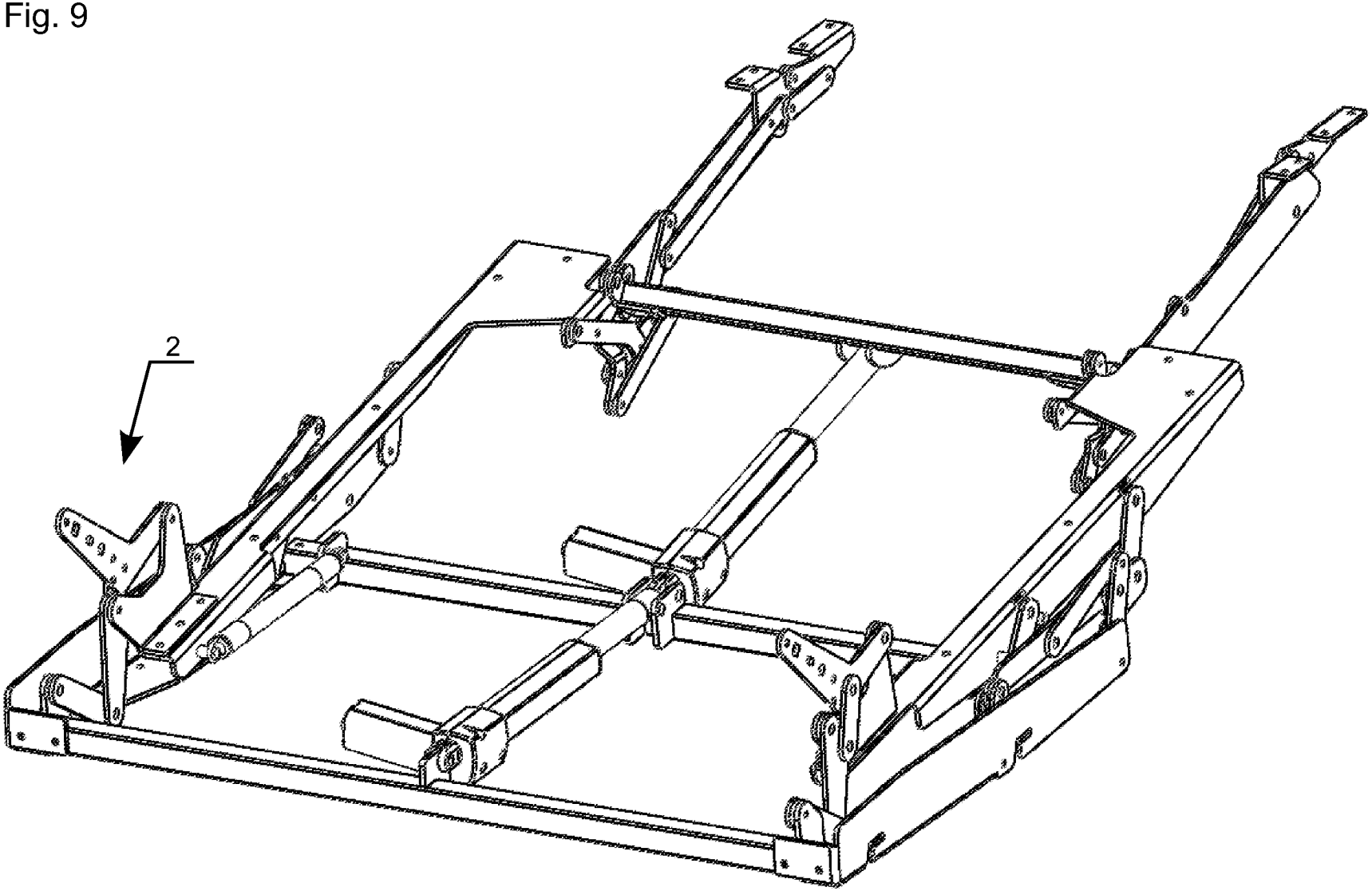

FIG. 5 detailed view of a piece of seating furniture according to the invention as shown in FIG. 3;

FIG. 6 shows a piece of seating furniture according to the invention in a second intermediate position;

FIG. 7 shows a piece of seating furniture according to the invention as shown in FIG. 6 from a different perspective;

FIG. 8 shows a piece of seating furniture according to the invention in the reclining position of the seat;

FIG. 9 shows a piece of seating furniture according to the invention as shown in FIG. 8 from a different perspective.

Figure 10A:
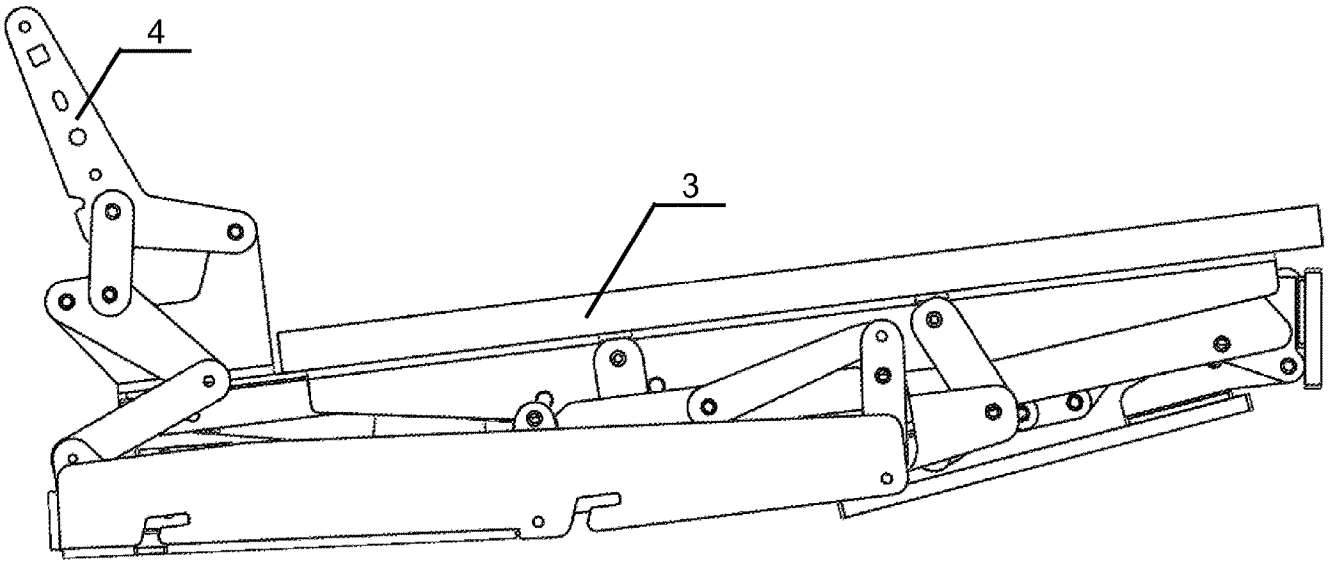
Figure 10B:
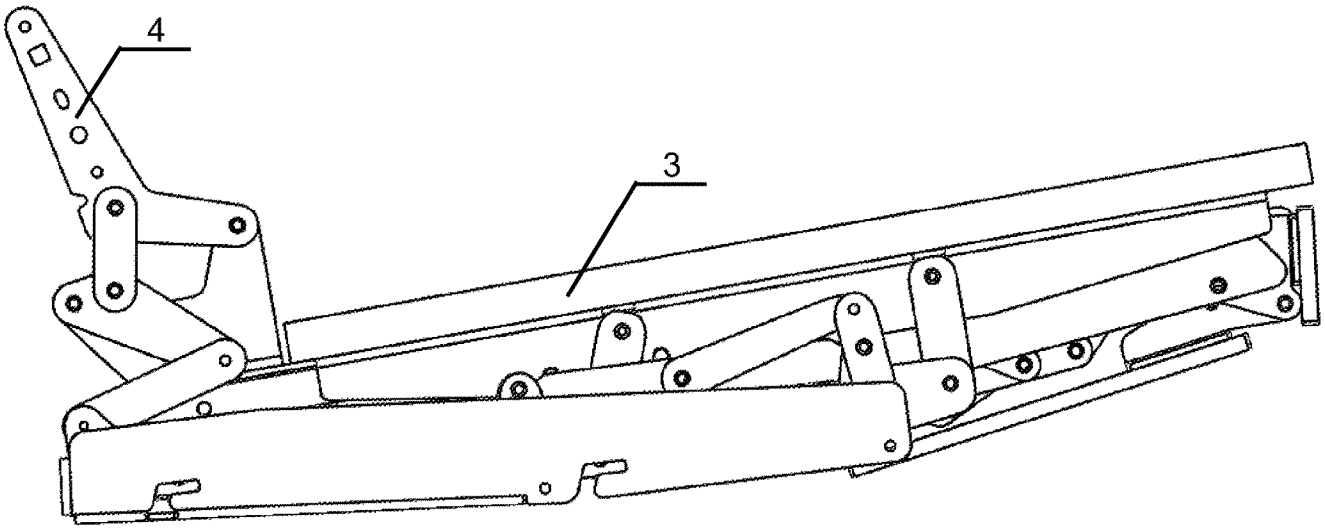

FIG. 10*a* shows a piece of seating furniture according to the invention with the seat part not adjusted in inclination and the back part pivoted relative to the seat part;

FIG. 10*b* shows a piece of seating furniture according to the invention with a seat part partially adjustable in inclination and a back part pivoted relative to the seat part.

DETAILED DESCRIPTION

The illustrations in the drawing show essentially only the mechanism of the seating furniture 1 according to the invention, without the parts that are not of interest here, such as in particular upholstery.

Some components mentioned below are duplicated due to a largely mirror-image structure of the mechanics of the seating furniture 1. These components will be referred to in the singular in each case below, and both components are hereby meant in each case.

Figure 1:
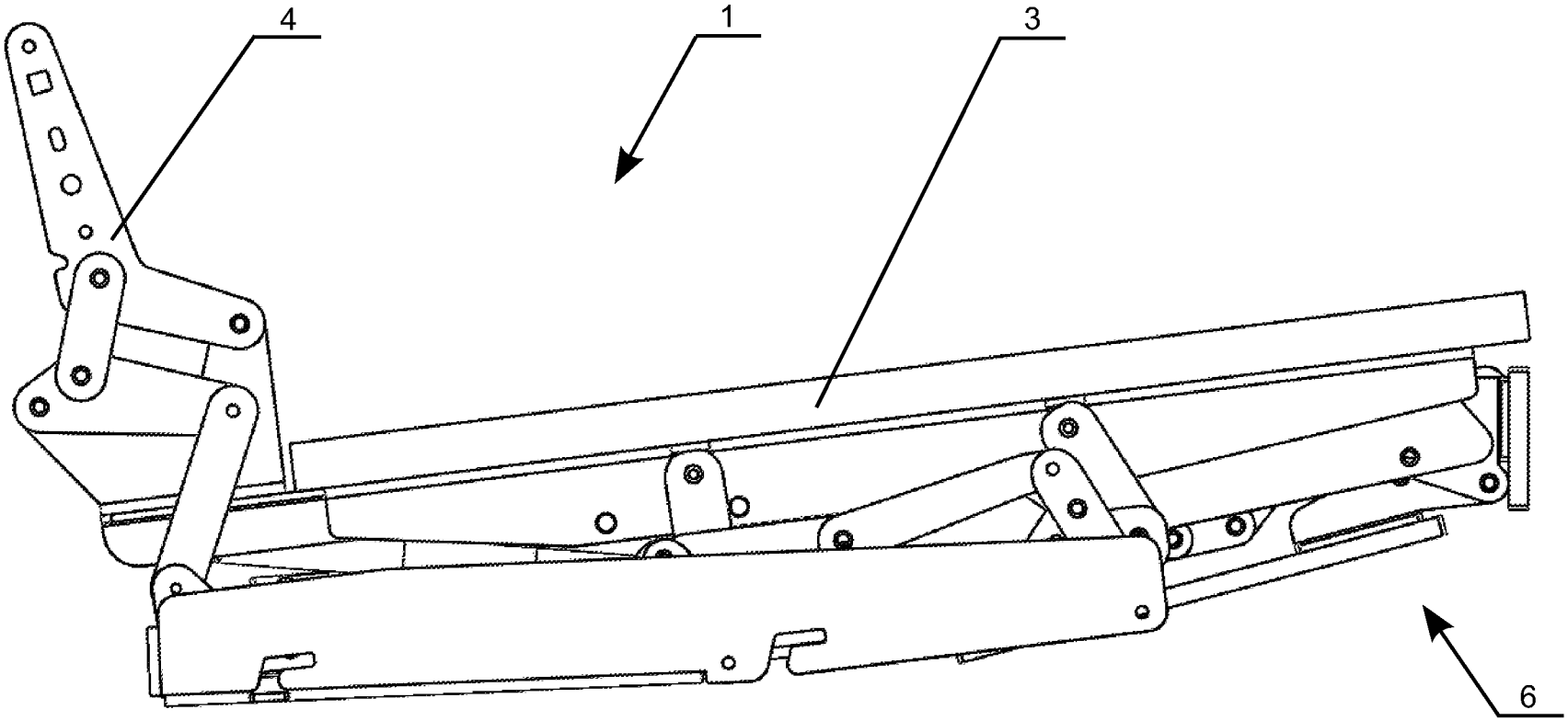
FIG. 1 shows a piece of seating furniture according to the invention in the sitting position of the seating furniture.

A piece of seating furniture 1 according to the invention comprises a chassis 5, a seat part 3, a back part 4 connected to the seat part 3 and/or the chassis 5 via at least one back-part adjusting mechanism 2, and a swing-out foot part 6, wherein the piece of seating furniture 1 is pivotable between a sitting position shown in FIG. 1 and a reclining position shown in FIG. 8.

The foot part 6 is connected to the seat part 3 via at least one foot-part adjusting mechanism 9, preferably in the form of at least five four-bar chains arranged one behind the other.

The foot-part adjusting mechanism 9 has a first 25 and a second 26 articulated lever each articulated to the seat part 3, wherein at least one of the first 25 and the second articulated lever 26 comprises a stop element 24 which, during the pivoting movement of the foot part 6, comes into contact with a stop surface of a seat part tab 27 connected to the front region of the seat part 3.

The back-part adjusting mechanism 2 has a mounting plate 20 fixedly connected to the seat part 3 and has an adjustment lever 21 articulated thereto, which is further connected to the chassis 5 via a first connecting lever 22 and to the back part 4 via a second connecting lever 23.

The seat part 3 is displaceable and adjustable in inclination relative to the chassis 5 by means of a first 10 and a second displacement unit 11 from a sitting position displaced towards the rear edge of the seating furniture 1 to a reclining position displaced towards the front edge of the seating furniture 1.

The terms 'front edge of the seat' and 'rear edge of the seat' refer to the perspective of a person sitting on the seating furniture with his or her legs facing forwards and his or her back facing backwards.

The first displacement unit 10 comprises a pivot guide, wherein a front link lever 7 and a rear link lever 8 form a four-bar chain with the seat part 3 and an intermediate support 14 connected to the second displacement unit 11.

The pivoting movement of the first displacement unit 10 in the direction towards the front edge of the seating furniture 1 is blocked by a stop element 18 on the seat part side.

The second displacement unit 11 is formed by a linear or by an approximately linear guide system, preferably by a lever adjusting mechanism 16 articulated to the chassis 5 or by a rack-and-pinion gear or by sliding blocks or rollers that can be moved in a form-fitting manner in a C profile, wherein the guide system, starting from the seating position of the seating furniture 1, is movable forwards along a movement path relative to the chassis 5, wherein the movement path is preferably linear and/or the movement path rises in the forward direction.

The first 10 and second displacement units 11 are attached to each other, wherein the intermediate support 14 is articulated to two pivot levers 28 of the lever adjusting mechanism 16, whereby the first displacement unit 10 is guided for displacement relative to the chassis 5.

The first displacement unit 10 is force-loaded by means of a tension spring 17.

The tension spring 17 is preferably coupled, on the one hand, to the seat part 3 and, on the other hand, preferably to the intermediate support 14 of the first displacement unit 10.

According to the invention, a first linear actuator 12 has a first end coupled to the chassis 5 and a second end coupled to the first displacement unit 10 via a first transverse strut 15 connected to the intermediate support 14 of the first displacement unit 10.

According to the invention, the first transverse strut 15 is displaceably guided both relative to the chassis 5 and relative to the seat part 3.

In accordance with the invention, a second linear actuator 13 has a first end coupled to the first transverse strut 15 and a second end coupled to the foot-part adjusting mechanism 9 via a second transverse strut 19 connected to the foot-part adjusting mechanism 9.

This arrangement of the first 12 and the second linear actuator 13 according to the invention, in which

- the first linear actuator 12 is coupled at a first end to the chassis 5 and at a second end to the first transverse strut 15 displaceably guided both relative to the chassis 5 and relative to the seat part 3, and
- the second linear actuator 13 is coupled at a first end to the first transverse strut 15, which is displaceably guided both relative to the chassis 5 and relative to the seat part 3, and at a second end to the foot-part adjusting mechanism 9 via the second transverse strut 19, which is connected to the foot-part adjusting mechanism 9,
  - enables an advantageous adjustment sequence, described below, of the seat part 3, the foot part 6, and the back part 4 between the sitting position and the reclining position of a piece of seating furniture 1 according to the invention.

Figure 2:
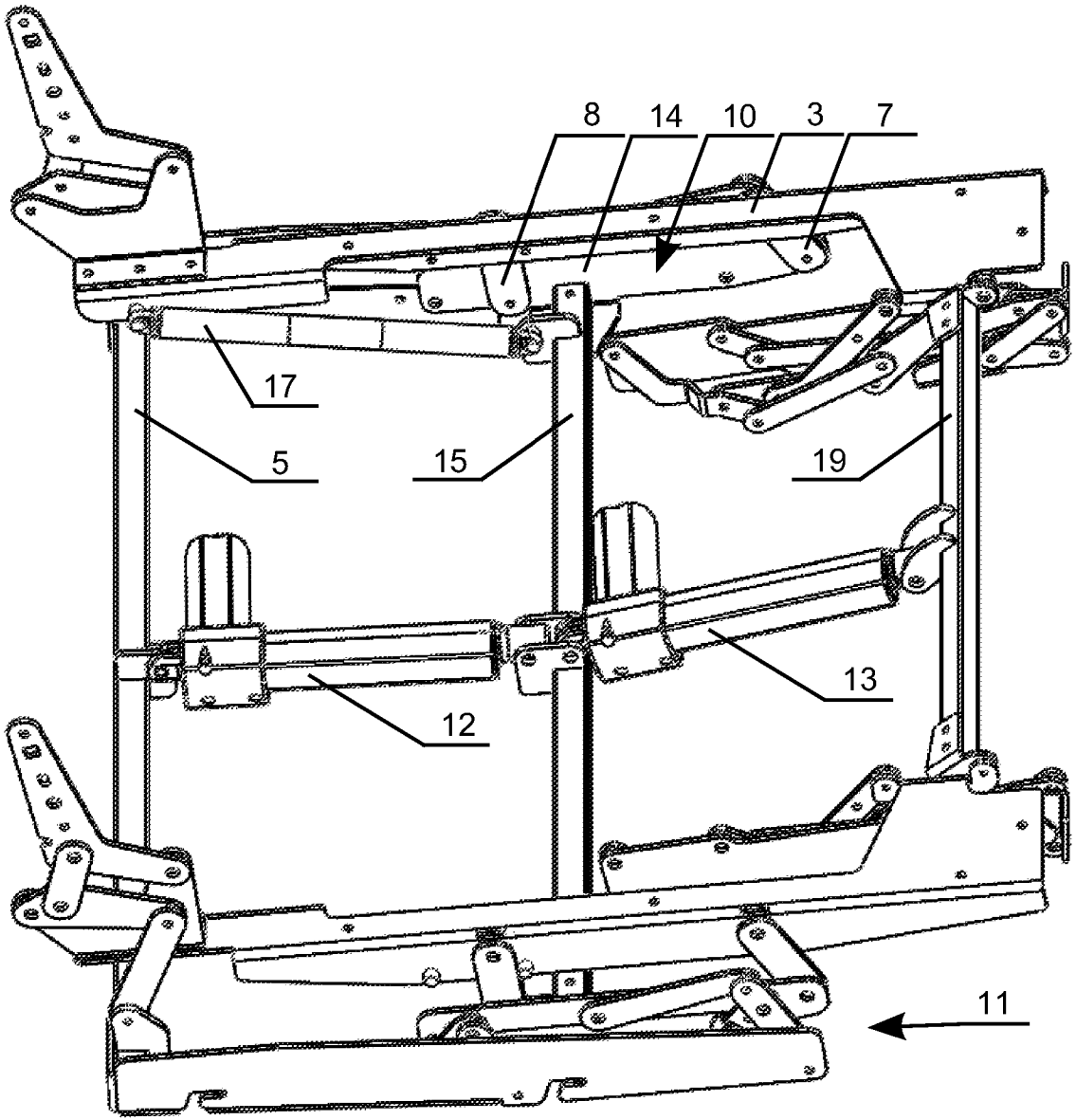
FIG. 2 shows a piece of seating furniture according to the invention as shown in FIG. 1 from a different perspective.

In the starting position or the seat position of the seating furniture 1, the second displacement unit 11 is held in its starting position by the first linear actuator 12 which is articulated between the chassis 5 and the first transverse strut 15, furthermore, by means of the second linear actuator 13 acting between the first 15 and the second transverse strut 19, the foot part 6 is held in the pivoted-in end position by means of the stop element 24 acting between the seat part tab 27 and the foot-part adjusting mechanism 9, and the first displacement unit 10 is defined in its pivoting position by the defined position of the foot part 6 and by means of the second linear actuator 13 (FIGS. 1, 2).

The second linear actuator 13 generates a linear stroke when actuated, consisting of at least a first and a second partial stroke, wherein in a first adjustment step of the seating furniture 1 from the sitting position to the reclining position, which is effected by the first partial stroke of the second linear actuator 13, the seat part 3 is displaced forwards by means of the first displacement unit 10, and in the process the rear region of the seat part 3 is lowered and the front region of the seat part 3 is raised, so that the seat part 3 is adjusted in inclination with respect to the seat position of the seating furniture 1 until the rear link lever 8 of the first displacement unit 10 comes into contact with the stop element 18 on the seat part side and the pivoting movement of the first displacement unit 10 is thereby blocked.

Figure 4:
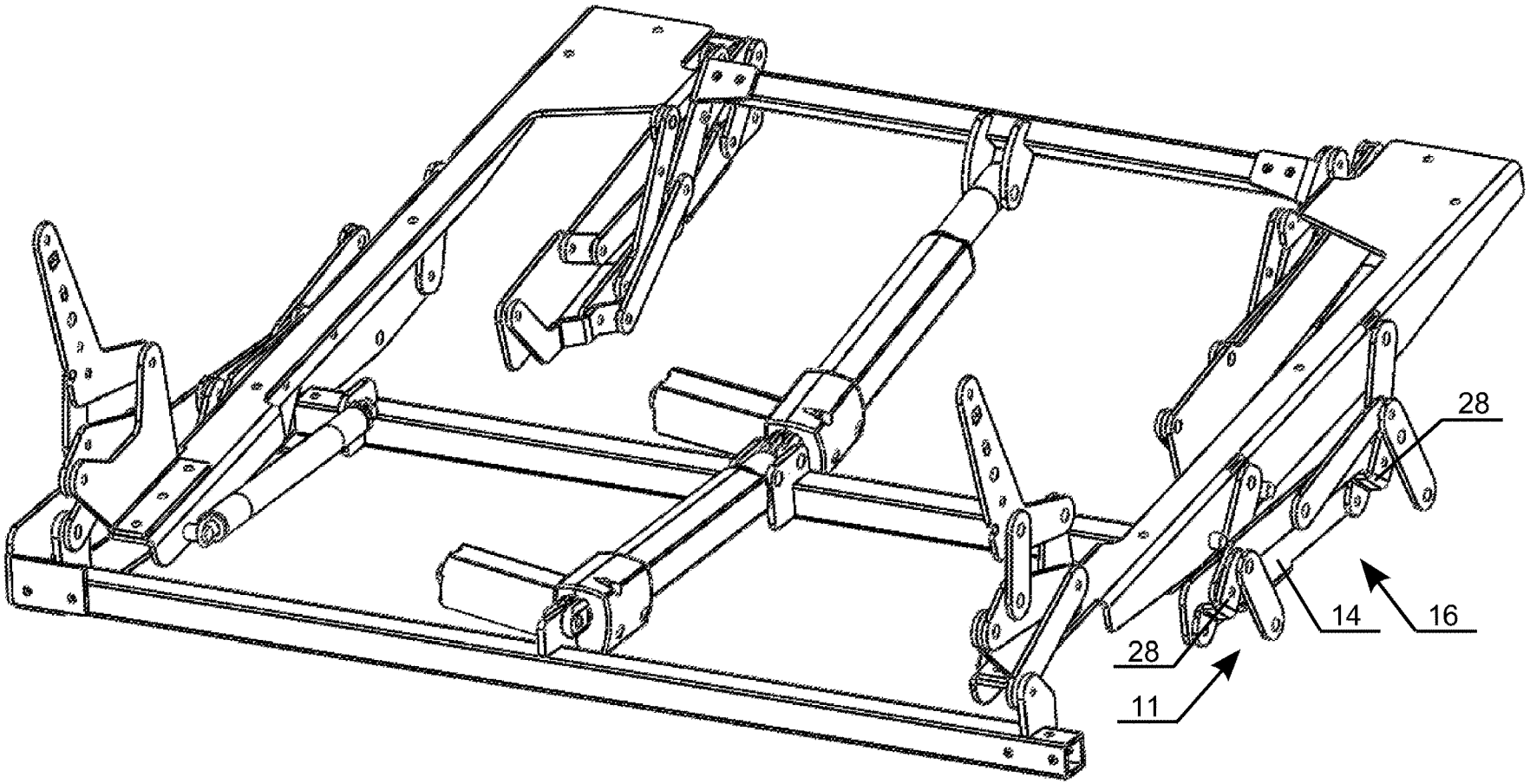
FIG. 4 shows a piece of seating furniture according to the invention as shown in FIG. 3 from a different perspective.

In this adjustment position of the seat part 3 the foot part 6 is not yet extended (FIGS. 3, 4, 5).

The tension spring 17 shortens during this first adjustment step and thereby supports the adjustment movement of the seat part 3, whereby first the seat part 3 is adjusted without pivoting the foot part 6 relative to the seat part 3 (FIGS. 3, 4, 5).

At the end of the first adjustment step, the front edge of the seat part 3 is at a greater distance from the upright plane of the seating furniture 1 than when the seating furniture 1 is in the sitting position, as a result of which a greater pivoting space is made available for the foot part 6 extending after this first intermediate position has been reached, thereby enabling a longer foot part 6 to be used.

The further advantage of this first intermediate position of the seating furniture 1 is the possibility for the user to adopt a more relaxed sitting posture compared to the sitting position of the seating furniture 1, without the footrest 6 already extending.

In a second adjustment step of the seating furniture 1 from the sitting position to the reclining position effected by the second partial stroke of the second linear actuator 13, while maintaining the inclination and displacement position of the seat part 3 relative to the chassis 5 achieved at the end of the first partial stroke and while maintaining the position of the back part 4 relative to the seat part 3, the foot part 6 is extended relative to the seat part 3 until the foot part 6 has reached the pivoted-out end position and the seating furniture 1 has thus reached a second intermediate position during the adjustment from the sitting to the reclining position (FIGS. 6, 7).

The arrangement of the first transverse strut 15, which is connected to the intermediate support 14 of the first displacement unit 10, is guided so as to be displaceable both relative to the chassis 5 and relative to the seat part 3, and to which both the first linear actuator 12 and the second linear actuator 13 are articulated according to the invention, enables an adjustment sequence, in which, when the second linear actuator 13 is actuated, the inclination of the seat part 3 is always adjusted first in the adjustment direction to the reclining position of the seating furniture 1 and only then is the foot part 6 extended, so that the foot part 6 can have the same length as in the seating furniture known from EP3143902A1, even without an electronic control.

In the reverse direction of adjustment, i.e., in the direction of the seat position of the seating furniture 1, the foot part 6 is first retracted until the stop element 24 comes into contact with the stop surface of the seat part tab 27 due to the spring force of the tension spring 17 that has to be overcome, and then the seat part 3 is adjusted to the starting position against the spring force of the tension spring 17.

A third adjustment step of the seating furniture 1 from the sitting position to the reclining position is effected by a linear stroke generated by actuation of the first linear actuator 12, wherein during this adjustment step, while maintaining the position of the foot part 6 relative to the seat part 3, a forward displacement of the seat part 3 relative to the chassis 5 and a pivoting of the back part 4 relative to the seat part 3 coupled to the displacement movement of the seat part 3 is effected by means of the lever adjusting mechanism 16 (FIGS. 8, 9).

All the above-mentioned adjustment steps effected by the first linear actuator 12 and by the second linear actuator 13 can be carried out separately and in any order or, if necessary, simultaneously, ensuring an adjustment of the back part 4 and of the foot part 6, which can be actuated independently of one another, and an adjustment of the back part 4 and of the seat part 3, which can be actuated independently of one another, so that in each adjustment position of the seat part 3 or of the foot part 6 a wall-away adjustment of the back part 4 into any desired pivoting position is possible and in each adjustment position of the back part 4 the seat part 3 or the foot part 6 can be pivoted into any desired position.

Furthermore, the sequence of the adjustment function of seat part 3, back part 4 and foot part 6, known from EP3143902A1, is ensured with two intermediate positions located between the sitting position and the reclining position, in that during the adjustment of the seating furniture 1 from the sitting position to the reclining position by means of the first 12 and the second linear actuator 13,

- with a first partial stroke of the second linear actuator 13, the seat part 3 is displaced forwards, without the foot part 6 being extended, and at the same time its inclination is adjusted until a so-called "lounge position", which is perceived as comfortable by the user, is reached (FIGS. 3, 4, 5).
- with a second partial stroke of the second linear actuator 13, the foot part 6 is extended in front of the seat part 3 without an adjustment of the seat part 3 relative to the chassis 5 and without an adjustment of the back part 4 relative to the seat part 3 until a so-called "relax position" is reached (FIGS. 6, 7),
- with a linear stroke of the first linear actuator 12, the seat part 3 is moved further forwards and at the same time the back part 4 is pivoted relative to the seat part 3 until the reclining position is reached (FIGS. 8, 9).

In addition to this adjustment sequence, known from EP3143902A1, a seating furniture 1 of the present invention allows many other adjustment combinations of the seat part 3, the foot part 6 and the back part 4, which increase the comfort of the seating furniture 1. For example, as shown in FIGS. 10*a*, 10*b*, when the seat part 3 is not or only partially adjusted in inclination, the back part 4 can be adjusted in a wall-away manner relative to the seat part 3.

The invention is not limited to the exemplary embodiment, but is variable in many ways within the scope of the disclosure.

All individual and combination features disclosed in the description and/or drawing are considered essential to the invention.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

The invention claimed is:

1. A piece of seating furniture, comprising:

a chassis;

a seat part; which is pivotable in inclination;

a back part, which is pivotable relative to the seat part;

at least one foot-part adjusting mechanism;

a first and second linear actuator; and a foot part, which is pivotable out and is connected to the seat part via the at least one foot-part adjusting mechanism, wherein the piece of seating furniture is adjustable between an upright sitting position and a reclining position, the seat part is displaced forwards relative to the chassis at least during a partial phase of the adjustment of the seating furniture from the sitting to the reclining position, the first and second linear actuator are configured to adjust the seat part, the foot part, and the back part between the sitting and the reclining position of the piece of seating furniture, the first linear actuator generates a linear stroke when actuated to cause at least one adjustment of the back part, the second linear actuator generates a linear stroke when actuated that causes at least one adjustment of the foot part, the first linear actuator, when actuated, produces a linear stroke and that causes an adjustment of the back part relative to the seat part, the second linear actuator, when actuated, produces a linear stroke consisting of at least a first and a second partial stroke, during the adjustment of the piece of seating furniture from the sitting position into the reclining position, the second linear actuator causes, with a first partial stroke, a displacement of the seat part relative to the chassis towards a front and a simultaneous inclination adjustment of the seat part, wherein during the first partial stroke of the second linear actuator the foot part is not extended or retracted relative to the seat part, and during the adjustment of the seating furniture from the sitting to the reclining position, the second linear actuator causes an extension of the foot part relative to the seat part with a second partial stroke following the first partial stroke.

2. The piece of seating furniture of claim 1, wherein the second linear actuator causes the extension of the foot part relative to the seat part with the second partial stroke while maintaining an inclination and displacement position of the seat part relative to the chassis achieved at the end of the first partial stroke and while maintaining a position of the back part relative to the seat part.

3. The piece of seating furniture of claim 1, wherein the first linear actuator generates the linear stroke when actuated and causes the adjustment of the back part relative to the seat part with a simultaneous adjustment of the seat part relative: to the chassis.

4. The piece of seating furniture of claim 1, wherein, to adjust the piece of seating furniture between the sitting position and the reclining position, the seat part is displaced relative to the chassis via a first and a second displacement unit.

5. The piece of seating furniture of claim 4, wherein the first displacement unit is attached to the seat part and to the second displacement unit, and the second displacement unit is connected to the chassis.

6. The piece of seating furniture of claim 4, wherein the first displacement unit has a pivot guide, wherein a front and a rear link lever form a four-bar chain with the seat part and an intermediate support connected to the second displacement unit.

7. The piece of seating furniture of claim 4, wherein a pivoting movement of the first displacement unit in a direction of a front edge of the piece of seating furniture is blocked by a stop dement on a side of the seat part.

8. The piece of seating furniture of claim 6, wherein the second displacement unit is a linear guide system comprising a lever adjusting mechanism, a rack-and-pinion gear, or sliding blocks or rollers that are moveable in a form-fitting manner in a C-profile, and the linear guide system, starting from the sitting position of the piece of seating furniture, is movable forwards along a path of movement relative to the chassis, wherein the path of movement rises in a forward direction.

9. The piece of seating furniture of claim 8, wherein the first and the second displacement units are attached to one another, the intermediate support is connected to at least one movable part of the linear guide system, and the first displacement unit is guided displaceably with respect to the chassis.

10. The piece of seating furniture of claim 6, wherein the first displacement unit is force-loaded by at least one tension spring, and the at least one tension spring acts between the intermediate support of the first displacement unit and the seat pant.

11. The piece of seating furniture of claim 10, wherein the second linear actuator acts between the first displacement unit, which is guided displaceably with respect to the chassis, and the foot-part adjusting mechanism in such a way that, when the first partial stroke is produced by the second linear actuator, only an adjustment of the seat part relative to the chassis is effected without an extension or retraction of the foot part relative to the seat part.

12. The piece of seating furniture of claim 6, wherein the first linear actuator is coupled at a first end to the chassis and at a second end to the first displacement unit via a first transverse strut connected to the intermediate support of the first displacement unit.

13. The piece of seating furniture of claim 12, wherein the second linear actuator is coupled at a first end to the first displacement unit via the first transverse strut connected to the intermediate support of the first displacement unit and at a second end to the foot-part adjusting mechanism via a second transverse strut connected to the foot-part adjusting mechanism.

14. The piece of seating furniture of claim 13, wherein the first transverse strut is displaceably guided relative to the chassis and to the seat part.

15. The piece of seating furniture of claim 13, wherein the first linear actuator is coupled with a first end to the chassis and with a second end to the first transverse strut displaceably guided both relative to the chassis and relative to the seat part, and the second linear actuator is coupled with a first end to the first transverse strut, which is guided displaceably both relative to the chassis and relative to the seat part, and with a second end to the foot-part adjusting mechanism via the second transverse strut, which is connected to the foot-part adjusting mechanism.

16. The piece of seating furniture of claim 1, wherein, during the adjustment of the piece of seating furniture from the reclining position to the sitting position, a pivoting movement of the foot part caused by the first partial stroke of the second linear actuator is blocked by a stop element, and by generating the second partial stroke following the first partial stroke of the second linear actuator, a rearward displacement of the seat part relative to the chassis and a simultaneous inclination adjustment of the seat part is effected.

* * * * *